US007103292B2

(12) United States Patent
Hirst et al.

(10) Patent No.: US 7,103,292 B2
(45) Date of Patent: Sep. 5, 2006

(54) HEAT INDICATING SYSTEM

(75) Inventors: Mark Hirst, Boise, ID (US); Richard Lee Swantner, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 71 days.

(21) Appl. No.: 10/689,464

(22) Filed: Oct. 20, 2003

(65) Prior Publication Data

US 2005/0084276 A1 Apr. 21, 2005

(51) Int. Cl.
*G03G 15/20* (2006.01)

(52) U.S. Cl. ..... 399/33; 399/122; 399/322; 399/328

(58) Field of Classification Search ..... 399/12, 399/13, 33, 122, 320, 328; 219/216; 432/60; 136/207; 362/183, 192, 800
See application file for complete search history.

(56) References Cited

U.S. PATENT DOCUMENTS

| | | | | |
|---|---|---|---|---|
| 3,648,152 | A | 3/1972 | Low | |
| 3,735,092 | A | 5/1973 | Traister | |
| 3,951,538 | A | 4/1976 | Bar-on | |
| 5,206,682 | A * | 4/1993 | Yamada et al. | 399/122 |
| 5,239,349 | A * | 8/1993 | Hoover et al. | 399/122 |
| 5,406,361 | A | 4/1995 | Kim | |
| 5,419,780 | A | 5/1995 | Suski | |
| 5,467,178 | A | 11/1995 | Mui et al. | |
| 5,493,378 | A | 2/1996 | Jamzadeh et al. | |
| 5,752,147 | A | 5/1998 | in't Zandt | |
| 5,754,917 | A * | 5/1998 | Fromm et al. | 399/33 |
| 5,778,278 | A * | 7/1998 | Jeon | 399/33 |
| 5,893,666 | A | 4/1999 | Aslam et al. | |
| 5,991,591 | A | 11/1999 | Chen et al. | |
| 6,201,938 | B1 | 3/2001 | Hollar et al. | |
| 6,399,872 | B1 | 6/2002 | Strnad | |
| 6,483,995 | B1 * | 11/2002 | Iwaki et al. | 399/12 |
| 6,883,929 | B1 * | 4/2005 | Dowling | 136/207 |

FOREIGN PATENT DOCUMENTS

| | | | |
|---|---|---|---|
| DE | 953502 | B | 11/1956 |
| DE | 4332337 | A1 | 3/1995 |
| DE | 19946806 | A1 | 4/2001 |
| JP | 02217876 | A | 8/1990 |

* cited by examiner

*Primary Examiner*—William J. Royer

(57) ABSTRACT

An indicating system in a device having a heat emitting member. The indicating system includes a thermoelectric generator and an indicating device. The thermoelectric generator is adapted to thermally couple to the heat emitting member and configured to convert heat from the heat emitting element to electrical energy. The indicating device is powered by the electrical energy and configured to provide indication of when a temperature level of the heat emitting member is above a temperature threshold.

24 Claims, 3 Drawing Sheets

HEAT INDICATING SYSTEM

CROSS REFERENCE TO RELATED APPLICATIONS

This patent application is related to U.S. patent application Ser. No. 10/684,634 entitled "DEPRESSURIZATION SYSTEM FOR A FUSER ASSEMBLY", and U.S. patent application Ser. No. 10/685,322 entitled "IMAGING DEVICE COOLING SYSTEM" filed concurrently herewith and incorporated herein by reference.

BACKGROUND OF THE INVENTION

Electrophotographic imaging devices, such as laser printers, fax machines, and photocopiers, are designed to produce an image on a print media, such as a sheet of copy paper. Electrostatic imaging devices generally include a photoconductive element that is selectively illuminated by a scanned laser beam or light emitting diode arrays in response to data representative of a desired image that is to be produced, wherein the incident light generates an electrostatic copy of the desired image on the photoconductive element. The electrostatic copy is then developed by first exposing the photoconductive element to toner powder that adheres to the charged portions of the photoconductive element and subsequently transferring the toner powder from the photoconductive element to the print media. The "loose" toner powder is then fused to the print media by a fuser unit.

Fuser units typically employ a combination of heat and pressure to fuse the toner powder to the print material. One common type of fusing unit comprises a pair of opposing rollers that form a fusing nip, with one roller serving as a fuser roller and the other roller serving as an idler pressure roller. By convention, the fuser roller is generally the roller that contacts the unfused toner and is the roller having the higher temperature if there is a temperature differential between the rollers, and the idler pressure roller applies pressure at the fusing nip to hold the print media in contact with the fuser roller. The fuser roller is generally heated while the idler pressure roller may or may not be heated.

To fuse the loose toner to print material, the print material is fed through the fusing nip at which point the fuser roller melts the loose toner and permanently affixes it to the print material. Fuser units are generally maintained at temperatures between 150° C. and 200° C. in order to properly fuse the loose toner to the print material. As a result, fusing units store a large amount of heat energy and can potentially continue to do so long after the associated imaging device is powered-off. In some instances, the heat energy stored in the fuser unit can be so large that some surfaces of the fuser unit can remain at very high temperatures for several tens of minutes, potentially even after the fuser unit is removed from the imaging device.

These high temperatures represent a potential burn hazard for individuals who may attempt to access the fuser unit. Presently, printed warning labels are placed at conspicuous locations on the fuser units to warn users of the potential burn hazard. However, such warnings are not indicative of whether the fuser unit is presently at a high temperature and are not always sufficient to prevent burns.

SUMMARY OF THE INVENTION

One embodiment of the present invention provides an indicating system in a device having a heat emitting member. The indicating system comprises a thermoelectric generator and an indicating device. The thermoelectric generator is adapted to thermally couple to the heat emitting member and configured to convert heat from the heat emitting member to electrical energy. The indicating device is powered by the electrical energy and configured to provide indication of when a temperature level of the heat emitting member is above a temperature threshold.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
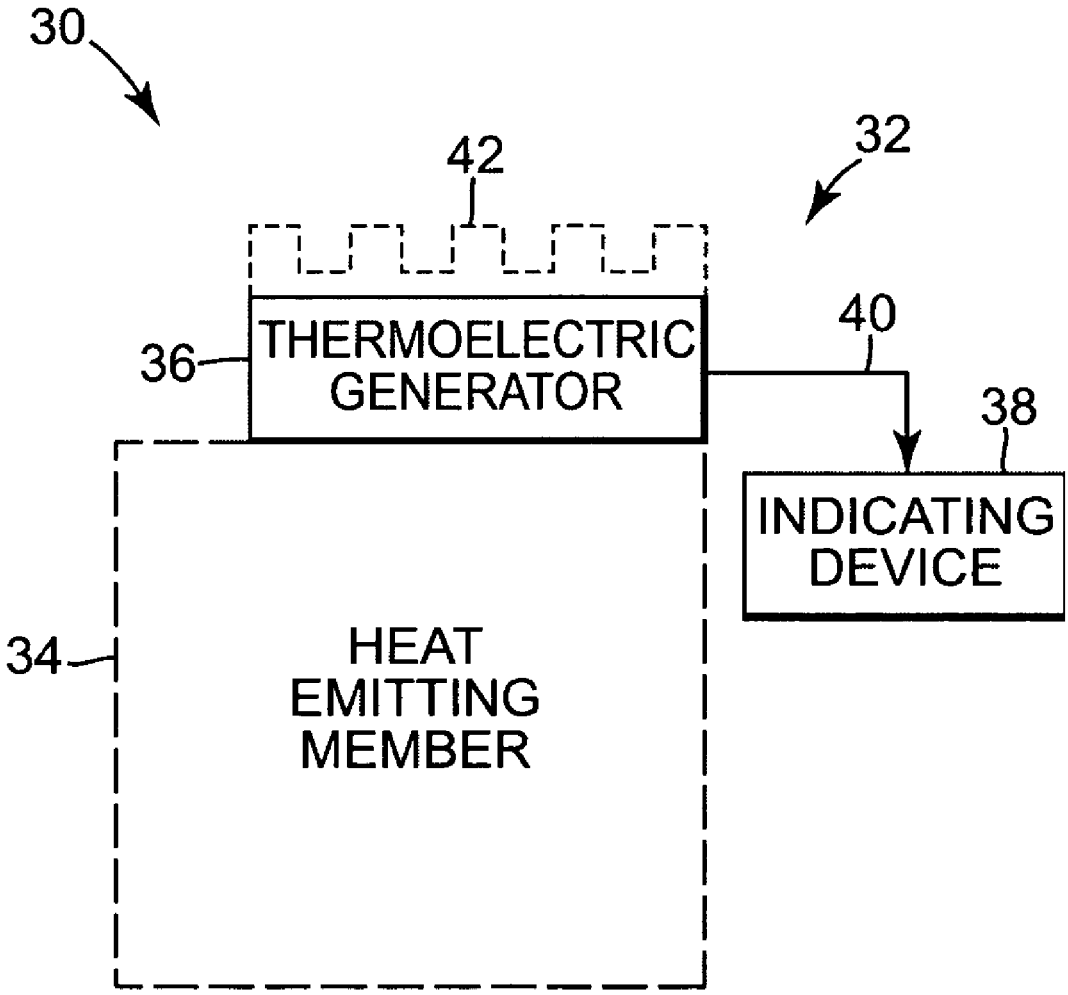
FIG. 1 is a block diagram illustrating exemplary embodiment of an indicating system according to the present invention.

FIG. 1 illustrates in block diagram form at 30 an indicating system 32 according to the present invention for indicating when a temperature level of a heat emitting member 34 represents a potential bum hazard. Indicating system 32 includes a thermoelectric generator 36 and an indicating device 38. Thermoelectric generator 36 is adapted to and positioned so as to be thermally coupled to heat emitting member 34, and is configured to convert heat from heat emitting member 34 to electrical energy. Indicating device 38 is powered by the electrical energy via a path 40 and is configured to provide indication of when a temperature level of heat emitting element 34 is at a potentially harmful level.

In one embodiment, indicating system 32 includes a heat sink 42 adapted to and positioned so as to be thermally coupled to thermoelectric generator 36. In one embodiment, thermoelectric generator 36 is mechanically coupled to heat emitting member 34. In one embodiment, indicating device 38 comprises a light emitting diode (LED). In one embodiment, the LED is configured to blink at a frequency substantially equal to a frequency at which the human visual response to flicker is most sensitive. In one embodiment, indicating device 38 further includes a warning label illuminated by light from the LED. In one embodiment, the warning label comprises a polycarbonate label having light transmitting characteristics, commonly referred to a "light pipe", such that when light from the LED shines into the label's edge it is distributed throughout the label so as to illuminate the label in a substantially even fashion.

Indicating system 32 provides a more effective warning that a heat emitting member 34 may be at a potentially harmful temperature level than conventional techniques employing traditional non-illuminated labels only. Additionally, if the heat emitting member 34 is part of a host device having a power supply, indicating system 32 provides such indication even if electrical power to the host device is lost or if the heat emitting member 34 is removed from the host device. Furthermore, when the heat emitting member 34 is part of a host device having a power supply, indicating system 32 can be utilized without adding cost for an additional connector to provide electrical power to the indicating system 32.

In one embodiment, thermoelectric generator 36 comprises a Peltier device operating in a Seebeck mode to generate a voltage to operate indicating device 38. In a Peltier device, when a current is circulated through a series loop formed by joining two wires of different materials, one junction generates heat while the other junction absorbs heat (becomes cool). When the current is reversed, the heat generating and absorbing junctions are reversed. While Peltier devices are best known as thermoelectric coolers, they can also function as thermoelectric generators. That is, when a temperature differential is applied across the junctions, the Peltier device generates a DC voltage between the junctions. This mode of operation is known as the Seebeck mode. Modern Peltier devices may be composed of heavily doped series-connected semiconductor segments, as described, for example, by Brun et al., U.S. Pat. No. 4,929,282; Cauchy, U.S. Pat. No. 5,448,109; and Chi et al., U.S. Pat. No. 5,714,791.

Figure 2:
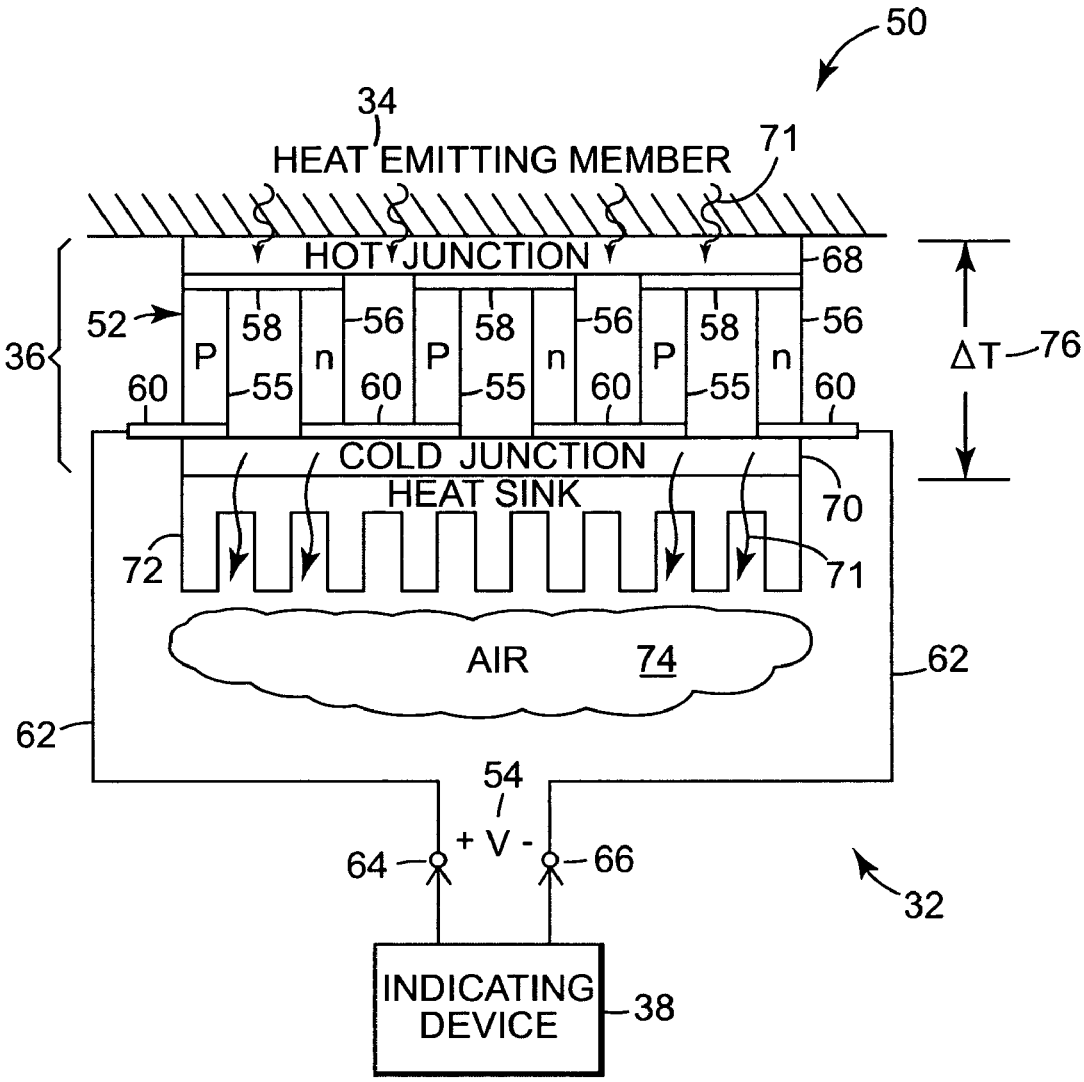
FIG. 2 is a diagram illustrating one exemplary embodiment of a thermoelectric generator employed by an indicating system according to the present invention.

FIG. 2 illustrates at 50, one embodiment of indicating system 32 wherein thermoelectric generator 36 comprises a Peltier device 52, operating in the Seebeck mode to generate an output voltage 54 to power indicating device 38. Peltier device 52 comprises a plurality of p-doped semiconductor segments 55 and a plurality of n-doped semiconductor segments 56, each segment having a first and a second end. The p-doped segments 55 create an excess of electrons, while the n-doped segments 56 create a deficiency of electrons. The p-doped segments 55 and n-doped segments 56 are connected in an alternating series fashion, with their first ends connected by a first plurality of conductor segments 58 and their second ends connected by a second plurality of conductor segments 60, wherein the first and second pluralities of conductor segments 58 and 60 comprise an electrically conductive material such as copper. The first and last conductor segment of the second plurality of conductor segments 60 are connected to a pair of wire 62 to provide output voltage 54 at a pair of output terminals 64 and 66. Indicating device 38 is coupled across terminals 64 and 66 and operated by output voltage 54.

The first plurality of conductor segments 58 is coupled to a hot junction 68 and the second plurality of conductor segments 60 is coupled to a cold junction 70. Hot junction 68 and cold junction 70 comprise a material that is highly thermally conductive, but electrically non-conductive, including a ceramic material such as alumina or aluminum nitride. Hot junction 68 is thermally coupled to heat emitting member 34 and cold junction 70 is thermally coupled to a heat sink 72, which is in contact with air 74. In one embodiment,the thermoelectric generator 36 is mechanically coupled to heat emitting member 34 and to heat sink 72. Heat emitting member 34 serves as a heat source, transferring heat 71 to hot junction 68, while heat sink 72 transfers heat 71 from cold junction 70 to air 74.

In operation, the temperature of heat emitting element 34 is greater than the temperature of air 74, thereby creating a temperature differential 76 between hot junction 68 and cold junction 70. The temperature differential, in accordance with the Seebeck Effect, results in Peltier device 52 generating output voltage 54 across terminals 64 and 66 to power indicating device 38. Output voltage 54 is proportional to temperature differential 76, with an increase in temperature differential 76 resulting in an increase in output voltage 54.

Figure 3:
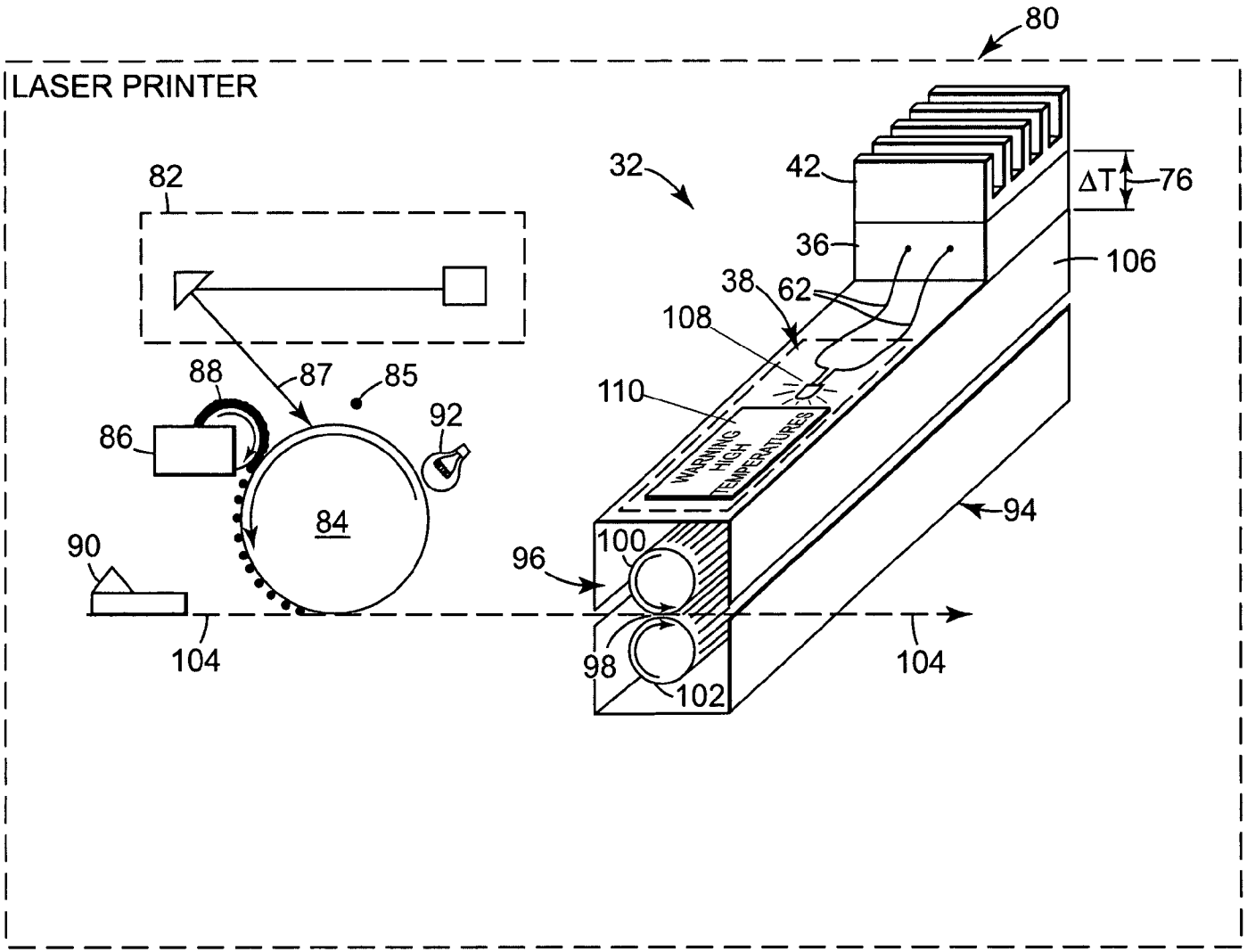
FIG. 3 is a block diagram illustrating one exemplary embodiment of an imaging system having an indicating system according to the present invention.

FIG. 3 illustrates one exemplary embodiment of a laser printer 80 in accordance with the present invention. Laser printer 80 includes a fuser unit 94 having an indicating system that converts heat emitted by the fuser unit 94 to electrical energy to power an indicating device 38 when the temperature of the fuser unit 94 is at a potentially harmful level. Laser printer 80 includes a laser scanning unit 82, a photoconductive drum 84, a charging station 85, a toner hopper 86, a developer roller 88, a paper source 90, a discharge lamp 92, and the fuser unit 94 having an integral indicating system 32 according to the present invention. Fuser unit 94 further includes a pair of opposing platen rollers 96 that form a fusing nip 98, with one roller being a fuser roller 100 and the other being an idler pressure roller 102.

To produce an image, the surface of photoconductive drum 84 is given a total positive charge by charging station 85. Laser scanning unit 82 then selectively illuminates photoconductive drum 84 with a light beam 87 that is representative of a desired image to be produced. As photoconductive drum 84 rotates, the incident light beam 87 discharges the surface of photoconductive drum 84 and essentially creates an electrostatic copy of the desired image on the surface of photoconductive drum 84. While photoconductive drum 84 rotates, developer roller 88 applies toner powder from toner hopper 86 to the surface of photoconductive drum 84, whereby the "loose" toner powder adheres to the electrostatic copy of the image on the drum's surface. A piece of copy paper is fed from paper source 90 along a paper path 104, and the loose toner powder in the form of the desired image is transferred from the surface of the photoconductive drum 84 to a surface of the copy paper as the copy paper is fed past the photoconductive drum 84. Discharge lamp 92 "erases" the electrostatic copy of the desired image from the surface of photoconductive drum 84.

The copy paper continues along paper path 104 to fuser unit 94. Fuser roller 100 is heated and contacts the loose toner powder on the surface of the copy paper, causing it to melt and adhere to the copy paper. Idler pressure roller 102 applies pressure at fusing nip 98 to hold the copy paper in contact with fuser roller 102 and improve heat transfer between fuser roller 100 and the toner powder, and to impart a smooth and even finish to the surface of the fused toners. To properly melt and fuse the loose toner to the copy paper, fuser roller 100 is typically maintained at a temperature between 150° C. and 200° C., with a housing 106 of fuser unit 94 often having a temperature in excess of 100° C.

Thermoelectric generator 36 has a first surface thermally and mechanically coupled to housing 106 and a second surface thermally and mechanically coupled to heat sink 42. While housing 106 has a temperature in the range of 100° C., heat sink 42 is in contact with air that may have a temperature in the range of 30° C., which creates temperature gradient 76 across thermoelectric generator 36 having a value of up to 70° C.

Thermoelectric generator 36 converts temperature gradient 76 to an output voltage provided to indicating device 38 via wires 62. In one embodiment, indicating device 38 comprises a light emitting diode (LED) 108 and a warning label 110. LED 108 is coupled to wires 62 and powered by the output voltage and illuminates warning label 110. Warning label 110 comprises a polycarbonate label adhered to housing 106 that is configured as a light pipe, as described above, to evenly illuminate warning label 110 with light from LED 108.

In one embodiment, LED 108 is configured to blink at a 4 Hz rate to further enhance the effectiveness of indicating device 38. In practice, the blink rate of LED 108 would be near the center point of blink rates at which human perception to light flicker is greatest. For effective indicator operation, the blink rate, or frequency, should be between 0.5 Hz and 15 Hz. Lower blink rates require less power and reduce the required size of thermoelectric generator 36. In one embodiment, to further minimize power consumption, LED 108 could be powered for only a small portion of the blink. For example, given a blink rate of 4 Hz, which yields a time period of 0.25 seconds, the LED 108 could be powered for 0.1 seconds and off for the remaining 0.15 seconds of the blink. This would further reduce average power requirements by approximately 60% (0.15÷0.25). In the case of a blink rate of 2 Hz, which yields a period of 0.5 seconds, if the LED 108 were powered for 0.1 seconds, the power consumption would be reduced by 80% over the power required for continuous operation of the LED 108. This allows the peak power of the LED 108 to be much higher, making warning label 110 much brighter and further improving the effectiveness of indicating system 32.

Indicating system 32 provides a more effective warning than conventional techniques employing traditional non-illuminated labels only that fusing unit 94 and its components may be at a potentially harmful temperature level. Additionally, indicating system 32 provides such indication even if electrical power to the laser printer 80 is lost or if fuser unit 94 is removed from the laser printer 80. Furthermore, indicating system 32 represents no additional electrical load to the power supply.

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An indicating system in a device having a heat emitting member, the indicating system comprising:

a thermoelectric generator having a first surface mechanically and thermally coupled to the heat emitting member and a second surface mechanically and thermally coupled to a heat sink, the thermoelectric generator configured to convert heat from the heat emitting member to electrical energy; and an indicating device powered by the electrical energy configured to provide indication of when a temperature level of the heat emitting member is above a temperature threshold.

2. The indicating system of claim 1, wherein the indicating device comprises:

a light emitting diode (LED).

3. The indicating system of claim 2, wherein the LED is configured to blink.

4. The indicating system of claim 3, wherein the LED is configured to blink substantially at a frequency at which human visual response is most sensitive to flicker.

5. The indicating system of claim 3, wherein the LED is configured to blink at a frequency substantially between 0.5 Hz and 15 Hz.

6. The indicating system of claim 2, wherein the indicating device further comprises:

a warning label adhered to the heat emitting member that is illuminated by the LED.

7. An indicating system in a device having a heat emitting member, the indicating system comprising:

a Peltier device operating in a Seebeck mode and having a hot junction thermally coupled to the heat emitting member and a cold junction thermally coupled to a heat sink the Peltier device configured to convert heat from the heat emitting member to electrical energy; and an indicating device powered by the electrical energy configured to provide indication of when a temperature level of the heat emitting member is above a temperature threshold.

8. A fuser comprising:

a heated fused roller positioned within a housing that absorbs heat from the heated fuser roller; and an indicating system comprising:

a Peltier device operating in a Seebeck mode and having a hot junction that is mechanically and thermally coupled to the housing and a cold junction that is mechanically and thermally coupled to a heat sink; and an indicating device powered by the electrical energy and configured to provide indication of a temperature level of the heat emitting member.

9. The fuser of claim 8, wherein the indicating device comprises:

a light emitting diode (LED).

10. The fuser of claim 9, wherein the LED is configured to blink.

11. The fuser of claim 9, wherein the indicating device further comprises:

a warning label that is illuminated by the LED.

12. The fuser of claim 11, wherein the warning label comprises:

a polycarbonate label configured as a light pipe such that when light from the LED shines into an edge of the label the light is distributed throughout the warning label so as to illuminate the warning label in a substantially even fashion.

13. The fuser of claim 11, wherein the warning label is coupled to the heat emitting member.

14. A laser imaging system comprising:

a fuser that generates heat; and an indicating system comprising:

a thermoelectric generator adapted to thermally couple to the fuser and thermally coupled to a heat sink, the thermoelectric generator configured to convert heat from the fuser to electrical energy; and an indicating device powered by the electrical energy and configured to provide indication of a temperature level of the fuser.

15. The laser imaging system of claim 14, wherein the thermoelectric generator comprises a Peltier device operating in a Seebeck mode.

16. The laser imaging system of claim 14, wherein the fuser comprises:

a heated fuser roller within a housing that absorbs and emits heat from the heated fuser roller.

17. The laser imaging system of claim 14, wherein the indicating device comprises:

a light emitting diode (LED).

18. The laser imaging system of claim 17, wherein the LED is configured to blink.

19. The laser imaging system of claim 18, wherein the LED is configured to blink substantially at a frequency at which human visual response to flicker is most sensitive.

20. The laser imaging system of claim 18, wherein the LED is configured to blink at a frequency substantially between 0.5 Hz and 15 Hz.

21. The laser imaging system of claim 17, wherein the indicating device further comprises:

a warning label illuminated by the LED.

22. The laser imaging system of claim 21, wherein the warning label comprises:

a polycarbonate label configured as a light pipe such that when light from the LED shines into an edge of the warning label the light is distributed throughout the warning label so as to illuminate the warning label in a substantially even fashion.

23. The laser imaging system of claim 21, wherein the warning label is coupled to the fuser.

24. A laser imaging system comprising:

a fuser comprising a heated fuser roller within a housing that absorbs and emits heat from the heated fuser roller; and an indicating system comprising:

a thermoelectric generator comprising a Peltier device operating in the Seebeck mode and having a hot junction mechanically and thermally coupled to the housing and a cold junction mechanically and thermally coupled to a heat sink, the thermoelectric generator configured to convert heat from the fuser to electrical energy; and an indicating device powered by the electrical energy and configured to provide indication of a temperature level of the fuser.

* * * * *

UNITED STATES PATENT AND TRADEMARK OFFICE

CERTIFICATE OF CORRECTION

PATENT NO. : 7,103,292 B2
APPLICATION NO. : 10/689464
DATED : September 5, 2006
INVENTOR(S) : Mark Hirst et al.

It is certified that error appears in the above-identified patent and that said Letters Patent is hereby corrected as shown below:

In column 2, line 37, after "potential" delete "bum" and insert -- burn --, therefor.

In column 6, line 13, in Claim 7, after "sink" insert -- , --.

Signed and Sealed this

Sixth Day of January, 2009

JON W. DUDAS
*Director of the United States Patent and Trademark Office*